US005793395A

United States Patent [19]

Tanaka et al.

[11] Patent Number: 5,793,395

[45] Date of Patent: Aug. 11, 1998

[54] INK SUPPLY DEVICE AND INK JET RECORDING APPARATUS USING SAID DEVICE

[75] Inventors: Kiyoharu Tanaka, Tokyo; Takashi Uchida, Yokohama, both of Japan

[73] Assignee: Canon Kabushiki Kaisha, Tokyo, Japan

[21] Appl. No.: 478,687

[22] Filed: Jun. 7, 1995

Related U.S. Application Data

[63] Continuation of Ser. No. 21,108, Feb. 23, 1993, abandoned.

[30] Foreign Application Priority Data

Feb. 26, 1992 [JP] Japan ..... 4-039490

[51] Int. Cl.[6] ..... B41J 2/175

[52] U.S. Cl. ..... 347/85; 347/30; 347/89; 347/93

[58] Field of Search ..... 347/84, 85, 89, 347/93, 30, 35; 415/88, 89, 120, 105, 110, 206; 416/155; 417/369, 391

[56] References Cited

U.S. PATENT DOCUMENTS

| | | | |
|---|---|---|---|
| 464,716 | 12/1891 | Robinson | 415/88 |
| 2,670,687 | 3/1954 | Waskosky | 415/88 |
| 3,824,029 | 7/1974 | Fabri et al. | 415/206 |
| 4,183,030 | 1/1980 | Kaieda et al. | 346/140 R |
| 4,313,124 | 1/1982 | Hara | 346/140 R |
| 4,345,262 | 8/1982 | Shirato et al. | 346/140 R |
| 4,373,860 | 2/1983 | Sloan | 415/206 |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,608,577 | 8/1986 | Hori | 346/140 R |
| 4,723,129 | 2/1988 | Endo et al. | 346/1.1 |
| 4,740,796 | 4/1988 | Endo et al. | 346/1.1 |
| 4,769,658 | 9/1988 | Oda et al. | 346/140 R |
| 4,947,191 | 8/1990 | Nozawa et al. | 347/30 |

FOREIGN PATENT DOCUMENTS

| | | | |
|---|---|---|---|
| 54-056847 | 5/1979 | Japan . | |
| 59-123670 | 7/1984 | Japan . | |
| 59-138461 | 8/1984 | Japan . | |
| 60-071260 | 4/1985 | Japan . | |
| 1-165446 | 6/1989 | Japan | 347/89 |
| 4037547 | 7/1992 | Japan . | |

OTHER PUBLICATIONS

Smith et al., "Ink Jet Pump," IBM Technical Disclosure Bulletin, vol. 20, No. 2, Jul. 1977, pp. 560–562.

*Primary Examiner*—John E. Barlow, Jr.

*Attorney, Agent, or Firm*—Fitzpatrick, Cella, Harper & Scinto

[57] ABSTRACT

In an ink jet recording apparatus, recording is performed by discharging ink through discharge ports in a recording head onto a recording medium. Ink flows into a housing from an ink storing portion through an ink inlet portion on an upper surface of the housing. The housing contains an impeller on an end of a shaft. An ink outlet portion of the housing is located tangentially with respect to the rotating impeller to supply ink to the recording head.

16 Claims, 15 Drawing Sheets

INK SUPPLY DEVICE AND INK JET RECORDING APPARATUS USING SAID DEVICE

This application is a continuation of application Ser. No. 08/021,108 filed Feb. 23, 1993, now abandoned.

BACKGROUND OF THE INVENTION

1. Field of the Invention

The present invention relates to an ink supply device for supplying ink to an ink jet recording head, and an ink jet recording apparatus using said device.

2. Related Background Art

Conventionally, in order to prevent discharge failures of the ink, discharge recovery operations have been performed in which an ink pressure pump is used to remove dirt or paper powders adhering to the surface of ink discharge ports, or to remove the thickened ink left within nozzles by expelling foreign substances out of the nozzles to wash the surface of the discharge ports. The ink pressure pump may be a gear pump, a bellows pump, or a piston pump, and ink supply devices using such pumps have been put to practical use.

However, when a gear pump is used, contaminants (abrasion powders) are produced from the mating portion, the seal member of rotational central shaft, or the sliding surface of bearing portion, because a pair of gears rotate in the ink. Since such contaminants are produced at any time while the pump is operating, the abrasion may progress, decreasing the pumping power; high single component precision and assembling precision are required to obtain a predetermined pumping power (ink pressure and flow rate).

In addition, the bellows pump and the piston pump include a sliding portion in the ink, which produces contaminants. A reverse flow check valve is necessary, and also produces contaminants in the opening or closing operation of the valve. To pressurize the ink continuously, a pressure tank is further necessary, so that the apparatus becomes larger and more complex.

Generally, the diameter of a discharge port for the recording head is minute, for example, about 20 μm in a 400 dpi recording head having 256 nozzles. If contaminants are produced in the ink pressure pump, they may clog the nozzles, causing a discharge failure of the ink, so that a desired image cannot be produced.

To cope with such malfunctions, a method has been proposed and put to practical use in which a filter is provided in an ink flow passage between the recording head and the ink pressure pump to withdraw contaminants before they enter the recording head.

However, in the conventional ink pressure pump as above described, the filter may become clogged. Then, the ink pressure in the recording head may be insufficient to wash away the thickened ink or paper powders on the surface of the discharge ports, resulting in a substantial reduction in the discharge recovery power. The ink which the recording head consumes during recording is refilled by itself due to capillary action in the nozzles. If the filter is clogged, refilling is slower because of increased flow resistance, so that the air is absorbed, causing a discharge failure. In the recording head a clogged filter may lead to thermal energy thickening the ink, or burning and damaging the head.

Further, image defects or breakage of the recording head may be caused. If the filter is clogged, the ink pressure between the filter and the pump increases, causing leakage through a connecting portion to the ink flow passage, so that the interior of the apparatus is contaminated with ink.

Specifically, a conventional example will be described below.

FIG. 14 shows a conventional example of ink recycling. Refilling means such as a cartridge 11, for example, allows the ink to be appropriately refilled to a sub-tank 53. In the pressure recovery recycle from the sub-tank 53, the ink is passed through a tube 52 via filter 12 to a head 9*c* by a pump 55. In the recording, the ink is passed through a tube 51 via filter 13 to the head 9*c*. On the liquid surface within the sub-tank 53, a float 111 is floating, descending when the ink level decreases; if the float 111 is detected by a light transmission type sensor 112, the timing for the ink refill is output.

A conventional ink jet recording apparatus as shown in FIGS. 13 and 14 had the following problems.

Since impurities within the ink could be only trapped when they were passed through the filter within the recording head, the clogging of the filter might occur relatively early in the use of the recording head, resulting in insufficient ink flow. Since it was impossible to exchange the filter itself, the recording head had to be exchanged, resulting in greatly increased operating costs.

Further, owing to the demand for high speed recording in recent years, the moving speed of the carriage 9 has tended to increase, making it necessary to reach a constant high speed in a short time, as well as return from a high speed and stop in a short time. The ink liquid surface of the sub-tank 53 within the carriage 9 might then greatly fluctuate due to inertia, causing the variation in pressure to the nozzles of the recording head, or necessitating a buffer space to be provided to prevent ink overflow from the sub-tank, resulting in a less compact apparatus.

SUMMARY OF THE INVENTION

It is an object of the present invention to provide an ink supply device allowing for stable recording over a long term and an ink jet recording apparatus using said device.

It is another object of the present invention to provide an ink supply device allowing the stable recording and discharge recovery of the recording head to be retained over a long term, without clogging of the nozzles or filter, in which a non-contaminating ink pressure pump is developed.

It is another object of the present invention to provide an ink supply device which can completely resolve malfunctions such as ink discharge failure or clogging by pressurizing the ink without producing contaminants (abrasion powder), due to an absence of sliding members within the ink.

Further, it is another object of the present invention to provide an ink supply device in which an easily exchangeable filter device can be provided, by providing a filter floating substantially on an entire area of the ink liquid surface in an ink reservoir, and in which disorder on the ink liquid surface due to inertia can be reduced by covering the ink liquid surface with the filer.

It is an additional object of the present invention to provide an ink jet recording apparatus using the ink supply device as defined above.

DETAILED DESCRIPTION OF THE PREFERRED EMBODIMENTS

The preferred embodiments of the present invention will be described below with reference to the drawings.

Figure 4:
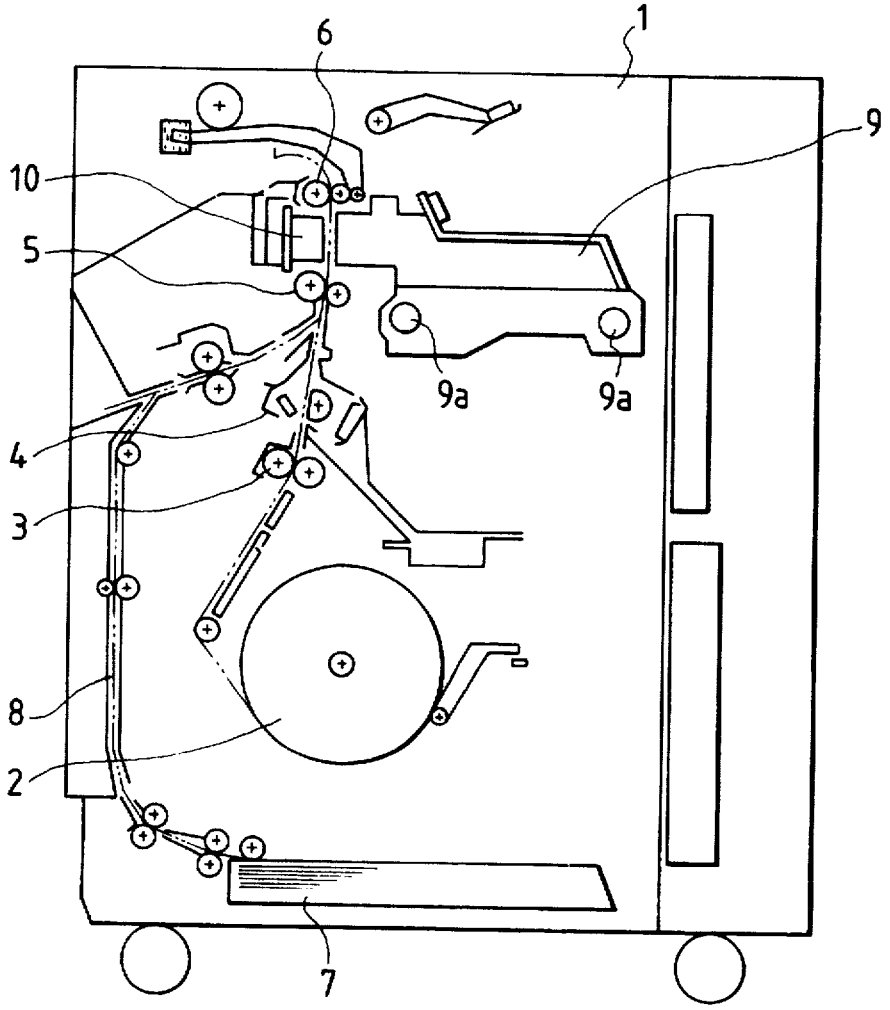
FIG. 4 is a cross-sectional view showing an embodiment of a recording apparatus to which an ink supply device according to the present invention is applied.

FIG. 4 is a cross-sectional view of a recording apparatus according to the present invention. Reference numeral 1 indicates a recording apparatus main device, 2 a long roll as the recording medium, and 4 a cutter for cutting the recording medium in a predetermined length. A pair of conveying rollers 3 conveys the recording medium in a conveying direction. A sub-scan roller 5 conveys a predetermined amount of the recording medium corresponding to a print width of the recording head (as will be described later), while correctly positioning the recording medium; a tension roller 6 conveys the recording medium after recording. With the above constitution, a conveyance path of the recording medium to be supplied from the roll 2 can be formed.

Reference numeral 7 indicates a cassette in which cut recording media are stocked, and 8 a guide portion for guiding the recording medium to be conveyed. In this guide portion, the recording medium from the cassette 7 enters the conveyance path from the roll 2 at a site immediately before the sub-scan roller 6. A carriage 9 has the recording head (not shown) mounted thereon, which is supported movably in a rearward direction as shown by a pair of scan rails 9*a*. A platen 10 is placed opposite the carriage 9 with the recording medium interposed therebetween, comprising suction or adsorbing means such as an air suction or an electrostatic holding plate for holding the recording medium in place; the recording medium is thus prevented from being raised or from coming into contact with the recording head.

The recording means (recording head) is an ink jet recording means for discharging ink by the use of thermal energy, comprising electrothermal converters for generating the thermal energy. Also, the recording means performs the recording by discharging the ink through discharge port by the use of pressure changes resulting from growth and shrinkage of bubbles due to film boiling which is caused by the thermal energy applied by the electrothermal converters.

Figure 6:
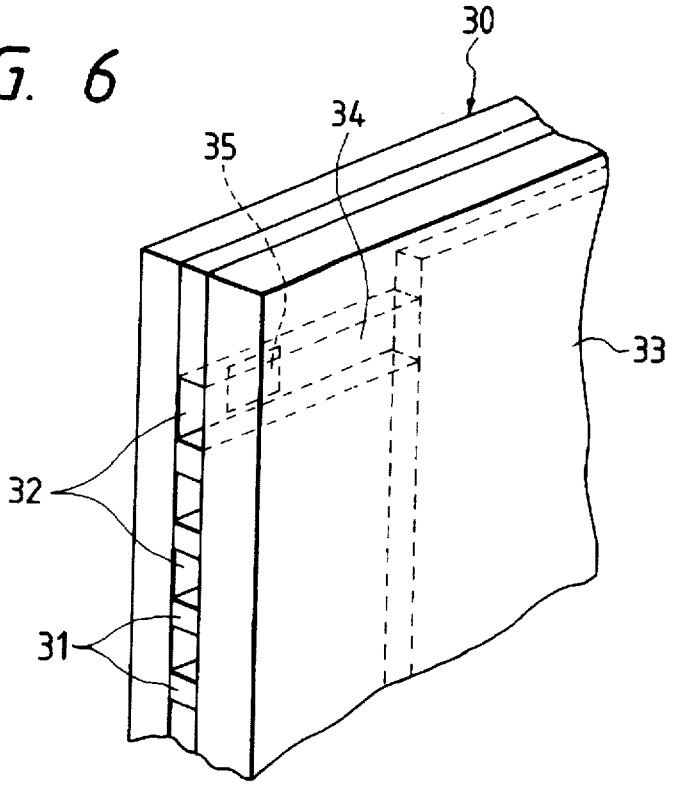
FIG. 6 is a partial perspective view showing schematically the structure of an ink discharge unit in a recording means (head).

FIG. 6 is a partial perspective view showing schematically the construction of an ink discharge unit in the recording means (recording head) 30. In FIG. 6, on a discharge port face 31, facing the recording medium 2 with a predetermined spacing (e.g., approximately 0.5 to 2.0 millimeter), a plurality of discharge ports 32 are provided at a predetermined pitch, and electrothermal converters (such as heat generating resistors) 35 for generating the thermal energy for use in discharging the ink are each disposed along a wall face of each liquid channel (nozzle) 34 communicating each discharge ports 32 to a common liquid chamber 33. In this embodiment, the recording head 30 is mounted on the carriage 9 in a positional relation in which the discharge ports 32 are arranged crosswise to a moving direction (scan direction) of the carriage 9. Thus, the recording head 30 drives (energizes) corresponding electrothermal converters 35 based on an image signal or a discharge signal, causes film boiling of the ink within liquid channels 34, and discharges the ink through discharge ports as a result of the pressure change occurring thereby.

Figure 5:
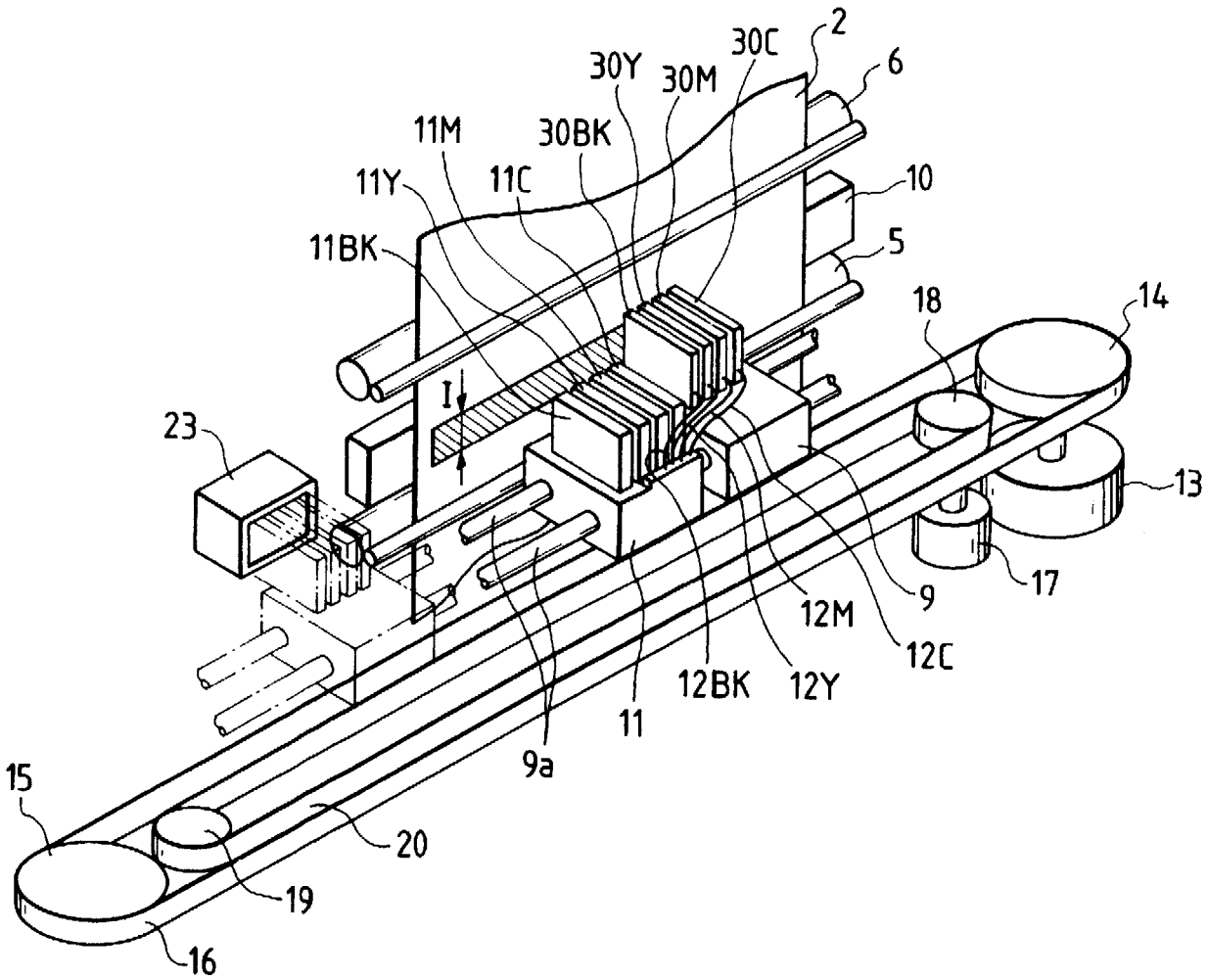
FIG. 5 is a front perspective view showing the operation of a recording head in a recording unit of FIG. 4.

Referring now to FIG. 5, the structure around the recording head will be described below.

The carriage 9 has recording heads $30_C$, $30_M$, $30_Y$ and $30_{Bk}$ corresponding to cyan, magenta, yellow and black, respectively. An ink supply device 11 for supplying the ink to the recording heads $30_C$, $30_M$, $30_Y$ and $30_{Bk}$, comprises ink cartridges $11_C$, $11_M$, $11_Y$ and $11_{Bk}$ corresponding to cyan, magenta, yellow and black, respectively. The ink supply device supplies the ink via tubes $12_C$, $12_M$, $12_Y$ and $12_{Bk}$ to recording heads $30_C$, $30_M$, $30_Y$ and $30_{Bk}$, by a pump (not shown). A pulse motor 13 drives the carriage, scanning in the main scan direction (left and right in FIG. 5); the carriage 9 is driven via a pulley 14 secured to the motor 13, a pulley 15 and a belt 16. A motor 17 drives the ink supply device 11, scanning in the main scan direction (left and right in FIG. 5) in synchronism with the carriage 9; the ink supply device 11 is driven via a drive pulley 18 secured to the motor 17, a pulley 19 and a belt 20.

The recording medium 2 may be roll or cut paper as previously described, and is conveyed in an upward direction in the figure by a sub-scan roller 5 and a tension roller 6. A cap member 23 is placed at a position to enable processing to prevent deterioration the image quality (hereinafter referred to as discharge recovery processing). With the nozzle faces of recording heads $30_C$, $30_M$, $30_Y$ and $30_{Bk}$ covered with the cap member 23, the ink is discharged through the recording head nozzles by driving the recording heads or by applying pressure. Further, within the cap member 23, high speed air flow is introduced into the recording head nozzle faces to blow off remaining inks, contaminants, and fluffs accompanying the ink discharge on the nozzle faces, thereby cleaning off the nozzle faces so that discharge failure and unevenness can be eliminated.

Referring now to FIGS. 4 and 5, a normal sequence of recording will be described below. In FIG. 4, if the recording medium conveyed from the roll 2 or the cassette 7 is detected by a recording medium detection sensor (not shown) located immediately before the sub-scan roller 5, the sub-scan roller 5 and the tension roller 6 on the conveyance path are driven by a predetermined amount, that is, until the leading end of the recording medium touches the tension roller 6.

In FIG. 5, if the leading end of recording medium 2 is conveyed to the tension roller 6, the carriage 9 and the ink supply device 11 are driven in a scan direction (to the right in the figure) by the motors 13 and 17, respectively. Along with this, the recording heads 30C, $30_M$, $30_Y$ and $30_{Bk}$ perform the recording in a record width as indicated by I in the figure based on the image signal.

After the line recording, the carriage 9 and the ink supply device 11 are driven back to their predetermined positions leftward in the figure, and the recording medium 2 is conveyed accurately corresponding to the print width I by each pair of rollers.

After the above sequence of recording and conveying the recording medium is repeated a number of times, the recording medium 2 is exhausted out of the apparatus.

Figure 1:
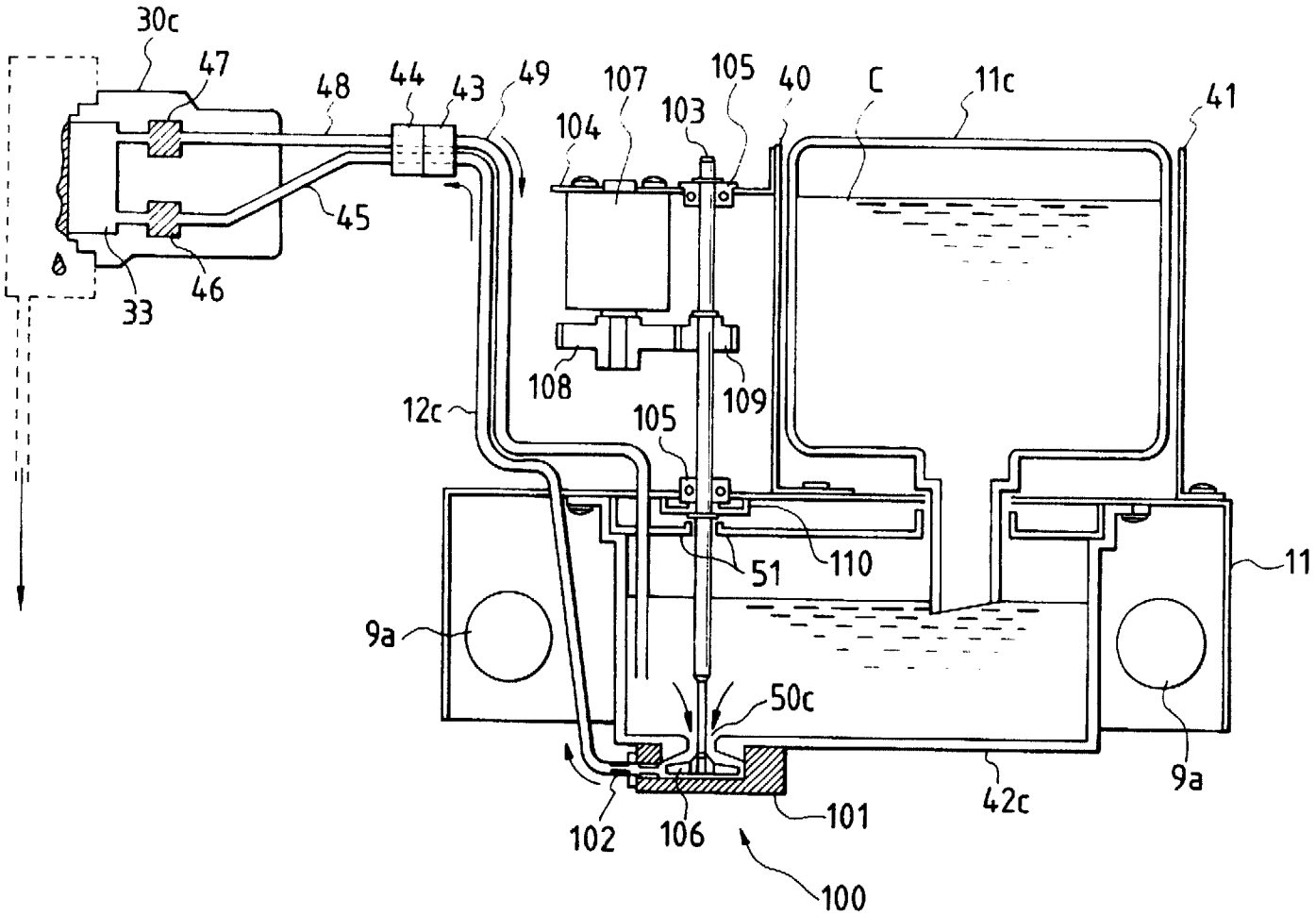
FIG. 1 is a cross-sectional view showing the constitution of an ink supply device according to the present invention.

Referring now to FIG. 1, the ink supply device according to the present invention will be described below.

First of all, the constitution of this embodiment will be described in accordance with the ink flow path in the discharge recovery processing. An ink cartridge 11*c* is inserted between front and back side plates 40, 41 to supply the ink C to an ink tank 42*c*. The ink tank 42*c* is disposed internally in the carriage 11 scanning on a pair of main scan rails 9*a*, comprising an ink pressure pump 100 (as will be detailed later) for enabling the discharge recovery processing by pressurizing and supplying the ink to the recording head 30*c*. If the pump 10 is activated, the pressurized ink C is forced out of an ink outlet 102 provided on a pump casing 101. The ink C is forced through an ink supply tube 12*c*, connectors 43 and 44, further through a supply tube 45 and a filter 46 on the recording head side into a common liquid chamber 33. The ink is then discharged through each liquid channel (nozzle) 34 and each discharge port 32 as shown in FIG. 6, thereby washing away contaminants or the thickened ink from the discharge faces. Also, part of the ink flows from the common liquid chamber 33 through the filter 47 and a discharge tube 48, further through connectors 43, 44 and a tube 49 to return to the ink tank 42*c*. Accordingly, in this embodiment, the discharge recovery processing of ink with a pressure circulation or recycle system is enabled.

In the discharge recovery processing, the carriage 11 with the recording head mounted thereon is placed opposite the cap member 23 to discharge the ink into the cap, which ink is then withdrawn into a waste ink bottle (not shown), as indicated by the chain line in FIG. 5.

On the other hand, the ink supply during the recording operation is conducted in such a way that with the pump 100 stopped, the ink C is refilled by itself through each tube from the ink tank 42*c* due to capillary action in the nozzles 34 of the recording head 30*c*.

The filters 46, 47 as shown in FIG. 1 are used to trap foreign contaminants possibly entering from the ink tank 42*c* or through the connectors 43, 44 in exchanging the ink cartridge 11*c* or the recording head 30*c*.

Figure 2:
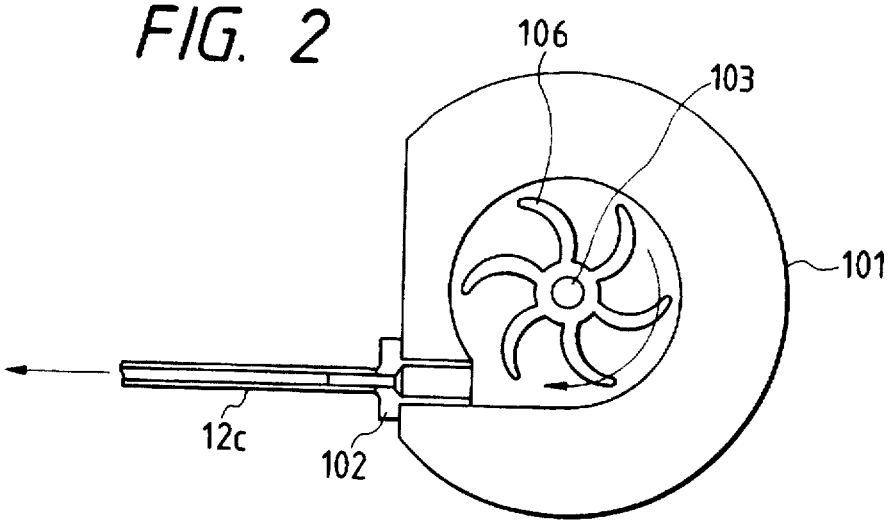
FIG. 2 is a cross-sectional view of a pressure pump.

Further, referring to FIGS. 1 and 2, the ink pressure pump 100 will be described.

A shaft 103 is supported rotatably at two points by a shaft support plate 104 secured to a front side plate 40 provided upwardly of the ink tank and a bearing member 105 attached to the carriage 11. One end of the shaft is extended through a bottom face of the ink tank 42*c*, and provided with an impeller 106. A drive motor 107 is installed on the shaft support plate 104 to rotate the shaft 103 having the impeller 106 by a motor gear 108 and a shaft gear 109 attached to the shaft 103. The shaft 103 and the impeller 106 are rotatably supported by the bearing member 105 in a state in which they are spaced away from the bottom of the ink tank, and further a pump casing 101 internally housing the impeller 106 has predetermined gaps in the axial and radial directions with respect to the bottom of the ink tank. If the drive motor 107 is activated, the impeller 106 is rotated, thereby introducing the ink through a through hole 50*c* on the bottom of the ink tank into the casing 101. As shown by a cross-sectional view of the pump in FIG. 2, the impeller rotates with the ink carried between each vane to give the ink a centrifugal force, thereby increasing the ink pressure within the casing. The ink is forced to move along an inner wall of the casing out of an ink outlet 102 provided in a tangential direction with respect to the inner wall, passing through each tube toward the recording head, whereby the discharge recovery processing is enabled.

Also, in FIG. 1, a contaminant receiving member 110 is secured to the shaft 103, immediately below the bearing member 105 attached to the carriage 11, and further a partition plate 51 is provided above the ink tank 42*c*. When the bearing member is a sliding bearing made of a self-lubricating material, for example, abrasion powders may be produced due to sliding with the shaft. Also, when it is a ball bearing, the lubricating oil may bleed and scatter away. These foreign substances are prevented from falling down by the contaminant receiving member 110 and the partition plate 51 so that they may not fall within the ink tank 42*c*.

The ink supply device has been described above with reference to cyan ink; the ink supply devices corresponding to the magenta, yellow and black inks are similarly described.

Next, based on a comparative experiment between a supply device using a conventional gear pump and an embodiment (hereinafter referred to as a turbine pump) according to the present invention as shown in FIG. 1, the superior points of the turbine pump according to the present invention will be described.

Figure 15A:
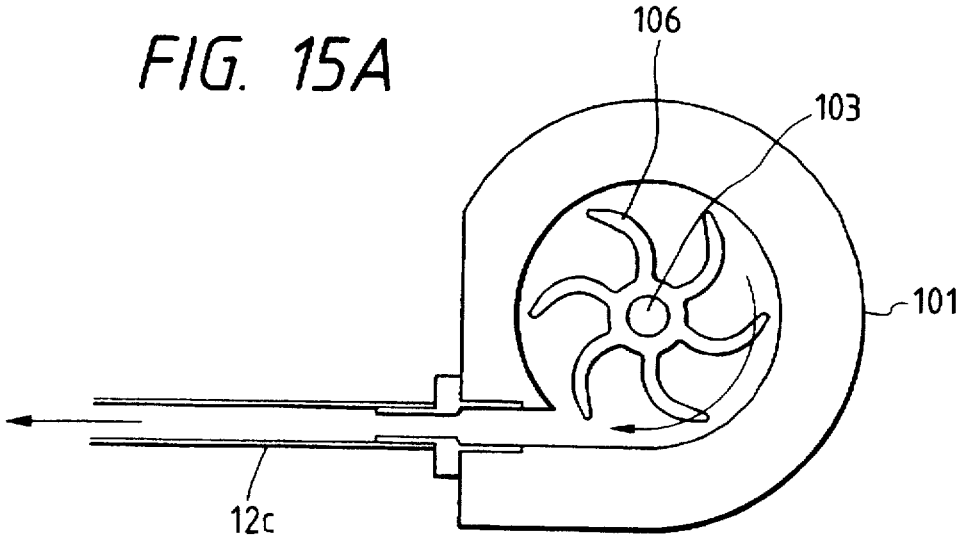
FIGS. 15A and 15B are schematic views of a turbine pump.
Figure 15B:
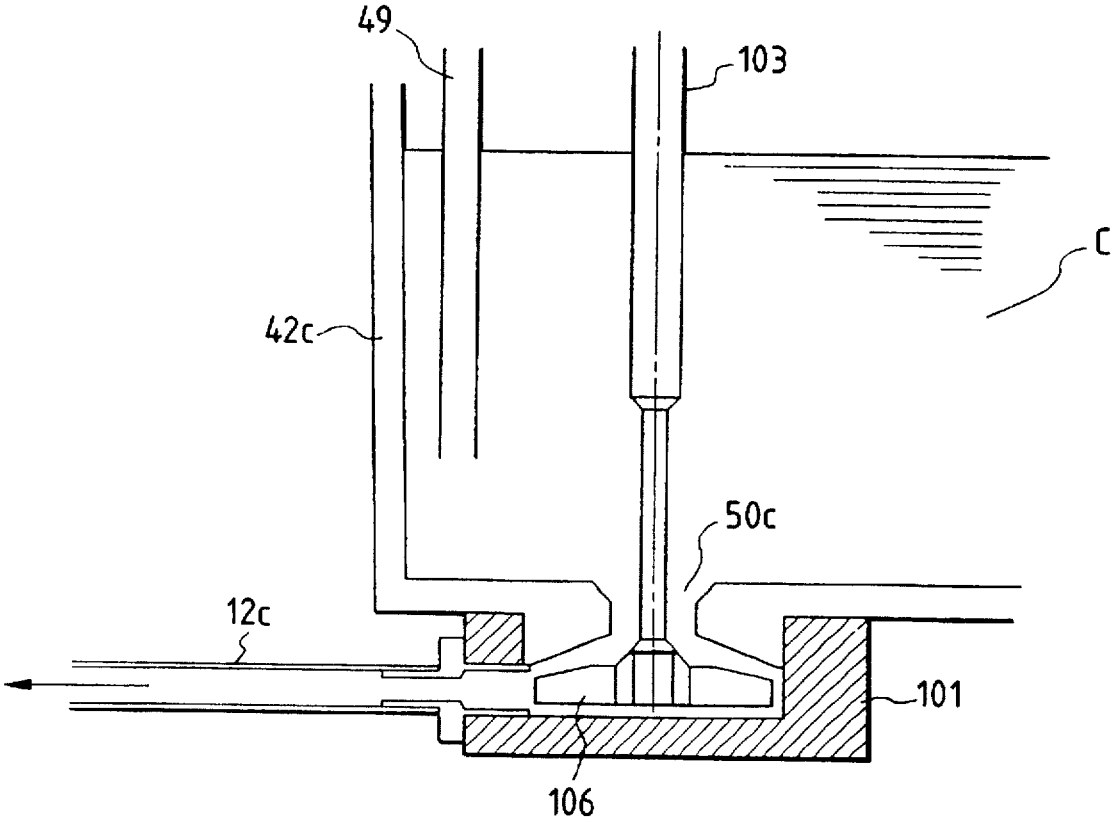
Figure 16A:
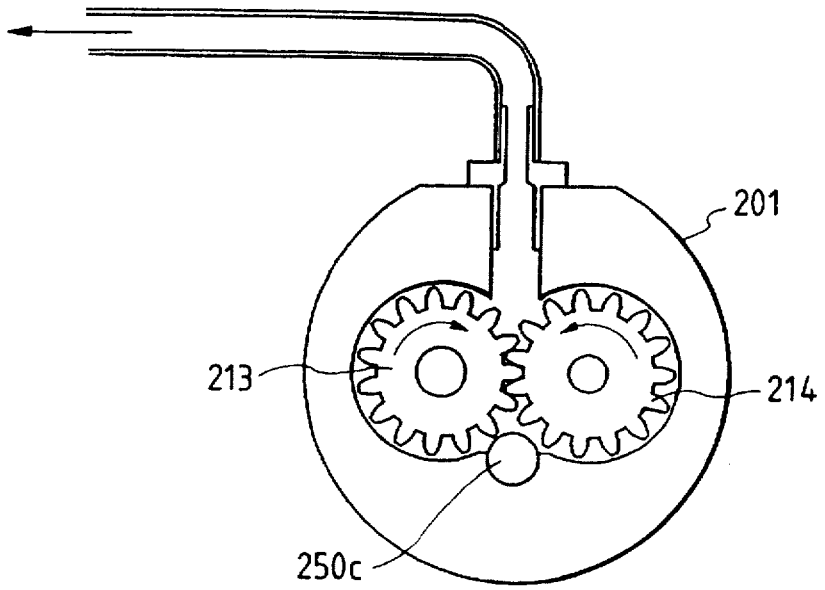
FIGS. 16A and 16B are schematic views of a gear pump.
Figure 16B:
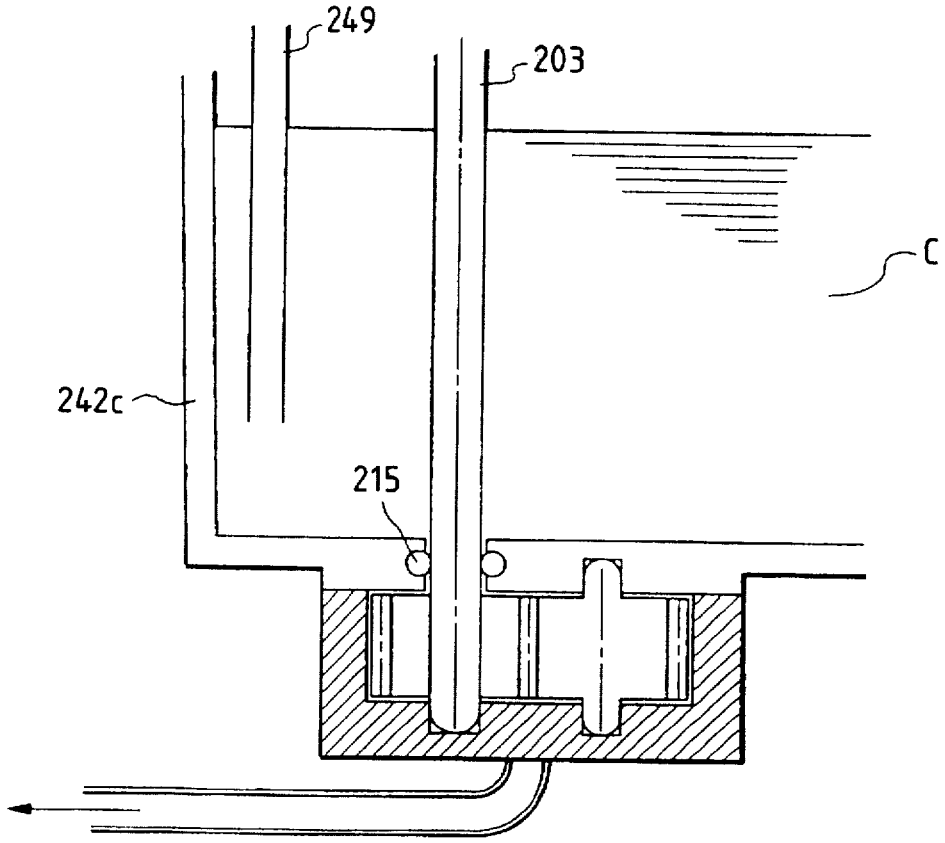
Figure 17B:
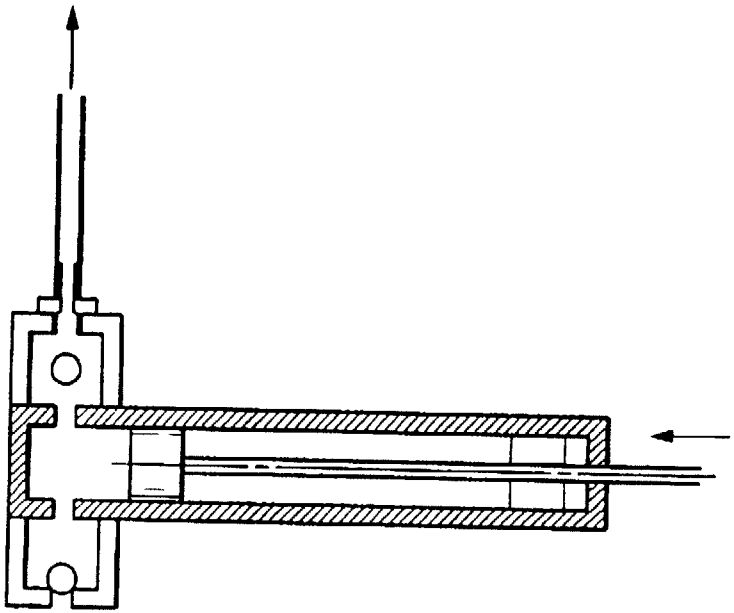
FIGS. 17A and 17B are schematic views of a piston pump.
Figure 17A:
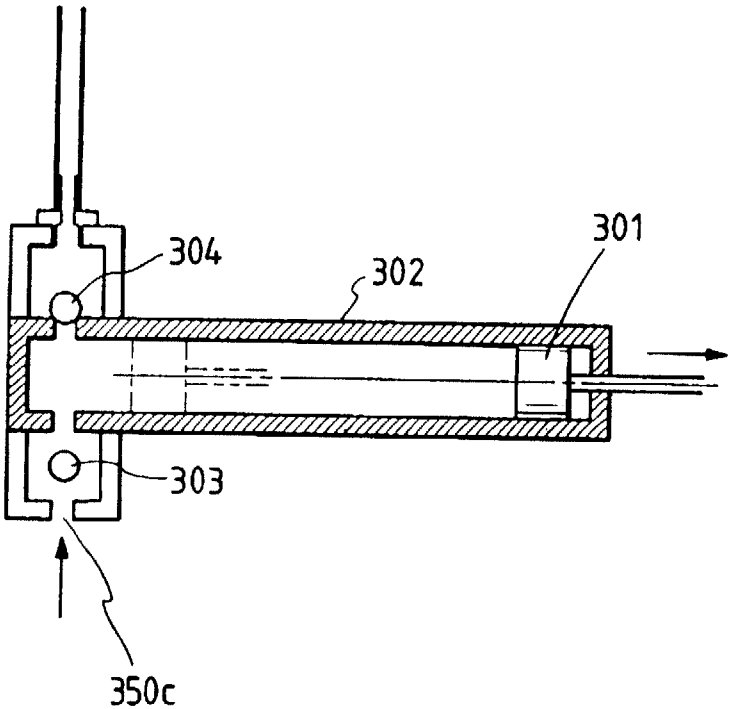

FIGS. 15A to 17 each show a schematic view of each pump. Herein, FIG. 15A is a schematic plan view of the turbine pump, and FIG. 15B is a schematic front view of the turbine pump. FIG. 15B shows the ink C, a supply tube 12*c*, an ink tank 42*c*, a return tube 49, a through hole (ink supply opening) 50*c*, a pump (turbine pump) 100, a casing 101, a shaft (drive shaft) 103, and an impeller 106. FIG. 16A is a schematic plan view of a gear pump , and FIG. 16B is a schematic front view of the gear pump. FIG. 16B shows a casing 201, a shaft (drive shaft) 203, a drive gear 213, a driven gear 214, a seal member 215, an ink tank 242*c*, a return tube 249, and a through hole (ink supply opening) 250*c*. FIG. 17A is a schematic cross-sectional view of a piston pump during a suction operation, and FIG. 17B is a schematic cross-sectional view of the piston pump during the discharge. FIG. 17B shows a piston 301, a cylinder 302, an inflow valve 303, an exhaust valve 304, and an ink inflow port 350*c*.

1. Comparison of Durability

The turbine pump produces no contaminants from abrasion in the pump operation over a long time, with no decrease in the pump efficiency (ink pressure), because the impeller 106 never comes into contact with other members.

The gear pump produces contaminants from abrasion with the gear teeth even if the pump is manufactured and assembled at high precision, resulting in decreased efficiency due to the abrasion.

Also, the piston pump has abrasion on the contact face with the valve, and in particular, if contaminants or fluffs enter the ink from outside of the ink supply device, the valves 303, 304 may be damaged, or the shield between the piston and the cylinder 302 may become incomplete, resulting in greatly decreased pump efficiency.

Figure 3:
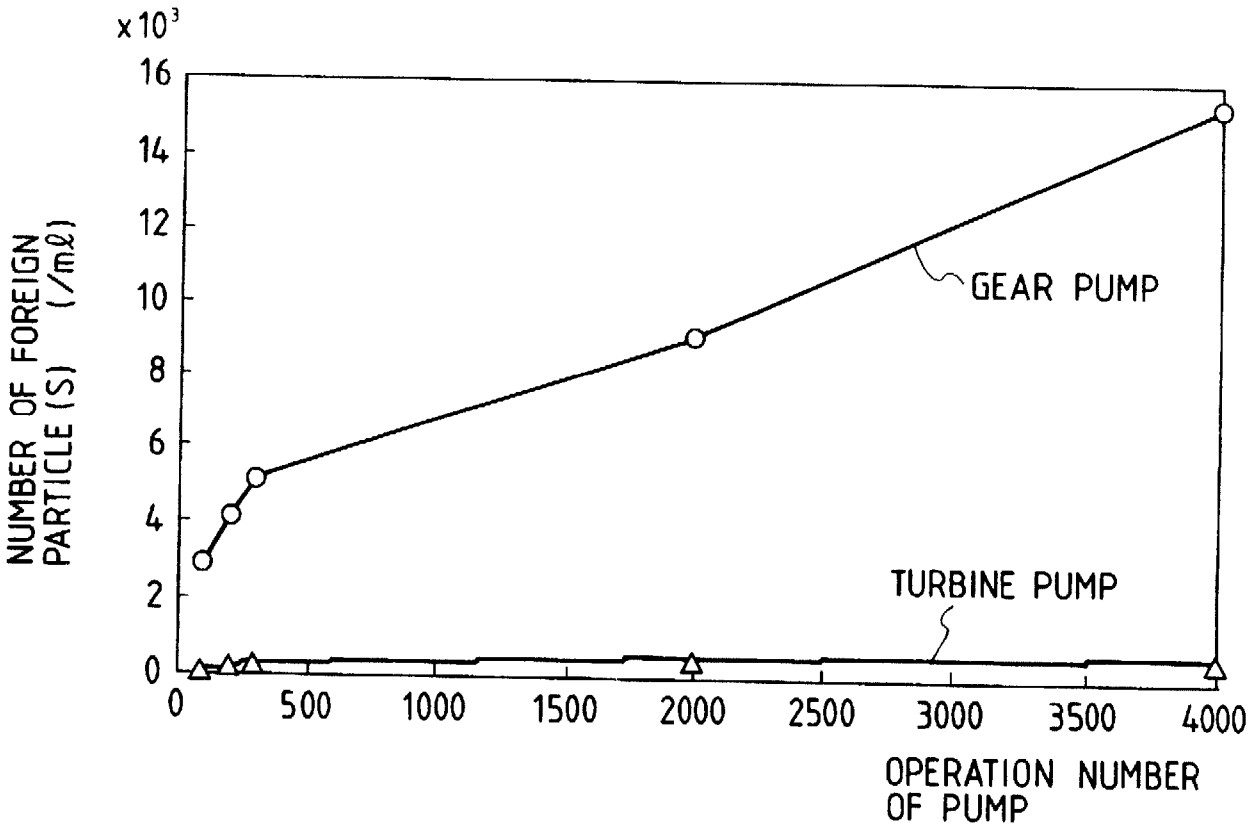
FIG. 3 is a graph showing a comparative experiment result, compared with the conventional example.

FIG. 3 is a graph showing a result of the comparative experiment between the supply device using the conventional gear pump and the turbine pump according to the present invention. In this experiment, the gears 213, 214 and the impeller 106 are made of the same material (Juracon M90-44); the number of foreign particles (1 to 20 μm in size) was investigated relative to the number of pump operations at the same ink pressure of 1.0 kg/cm$^2$. As can be seen in FIG. 3, the production of foreign particles is greater in the conventional gear pump, and foreign particles continue to be produced as long as the operation is continued.

On the contrary, the turbine pump according to the present invention has an extremely low number of foreign particles, with no increasing trend in foreign particle production.

In addition, based on the experimental conditions as follows, a comparative experiment between the turbine pump and the gear pump was performed.

| Experimental conditions | |
|---|---|
| (a) Ink pressure 1.0 kg/cm$^2$, with corresponding diameter of casing | |
| (b) Impeller configuration of the turbine pump: | |
| Outer diameter | ϕ19 mm |
| Number of vanes, | six |
| Average width of vane, | 1.2 mm |
| Shaft diameter on the mounting portion of vanes, | ϕ6 mm |
| Projection area in the axial direction, | 81.5 mm$^2$ |
| (c) Gear of the gear pump | |
| Nunber of gears, | 15 |
| Module, | 0.8 |
| Thickness of gear, | 8 mm |
| Projection area in the axial direction, | 113.1 mm$^2$ × 2 = 226.2 mm$^2$ |

2. Comparison of the Air Residing Within the Pump

If the air (air bubble) resides within the pump, the air may be subdivided and introduced through the supply tube 12*c* into the recording head while the pump is operated. If the recording operation is carried out while those bubbles enter the ink liquid channels 34 communicating to the discharge ports of the recording head, there is a risk that the bubbles may act as air dumpers, resulting in abnormal ink discharge. Also, if the bubbles exist near a heater 35, the ink may be scorched within the liquid channels 34, or thickened in the liquid channels 34 being clogged by the ink.

The turbine pump of the present invention has a gap of about 1 mm between the impeller 106, and the casing 101 containing the impeller 106 or the bottom of the ink tank 42*c*. When the ink is injected into an empty ink tank 42*c*, the air (bubble) within the casing 101 is caused to move upward due to buoyancy, further moving upward along the slanted planes above the interior of the casing 101 shaped conforming to a contour of the impeller 106, and out of the ink inflow port 50*c*, so that there is no air remaining within the casing 101. The ink inflow port 50*c* which is an outlet port of bubbles is located at a rotational center of the impeller 106 to be effective to remove those bubbles.

On the other hand, for example, the gear pump has a small gap of about 0.1 mm between gears 213, 214 and the casing 201 in both a thrust direction and a radial direction, so that it is quite difficult to remove the air (bubble) from the casing 201. Although due to buoyancy the bubbles move upward, the bubbles may reside within the upper interior of the casing 201 of a flat shape corresponding to an upper face of the gear pump, because an ink inflow port 250*c* which is an outlet port of the air (bubble) from the casing 201 is spaced away from a pair of gears 213, 214 in the axial direction thereof. Although a certain amount of bubbles can be removed from the casing 201 by the initial operation of the gear pump, in particular, bubbles residing around the rational axis of the gears are difficult to remove sufficiently only with the operation of the pump. If the gear pump is driven in such a state, ink containing the bubble may be supplied to the recording head, thereby causing a discharge failure of the ink.

If the projection areas of the turbine and gear pumps in the axial direction are compared, it may be seen that the turbine pump allows bubbles to be replaced with the air more smoothly, because the projected area of the turbine pump is about one-third that of the gear pump.

In an instance of the piston pump, where bubbles reside within a cylinder 302, a quantity of fine bubbles will occur due to turbulent flow of ink and temporary reduction in pressure, when the ink is absorbed into the cylinder 302, thereby causing a discharge failure of the ink. Also, when the pump is stopped, the ink is pressurized by the increased volume due to expanded bubbles caused by temperature elevation within the apparatus. As a result, the ink may flow out through ink discharge ports 32 of the recording head.

3. Comparison of Refill

In this embodiment, the pump is stopped during the recording operation, and the ink C for use with the recording is refilled from the ink tank 42*c* to the liquid channels 34 due to capillary force of the ink in the liquid channel 34 of the recording head 30.

The ink supply device of this embodiment has a passage of refilling the ink from the ink tank 42*c* directly through a return tube 49 and a passage of refilling the ink through a supply tube 12*c* via the pump 100, whereby the refill can be performed rapidly using two passages through the supply tube 12*c* and the return tube 49, because the turbine pump has a wide gap between the impeller 106 and the casing 101, as previously described. On the other hand, the g ear pump has a large flow resistance because its corresponding gap is smaller, resulting in a much longer refilling time.

Also, in an instance of the piston pump, since at least one of the inflow valve 303 and the outflow valve 304 is closed, one refill passage is completely shielded.

The refill time will determine the drive frequency of the ink discharging head; a long refill time is thus not conducive to high speed recording. Also, it is inappropriate for a recording head of the full-line type in which a quantity of ink must be refilled in a shorter time.

4. Comparison of Ink Pressure

In an instance of the turbine pump, the gap between the impeller 106 and the casing 101 has a wide tolerance. Even if the gap is varied in a range from 0.5 mm to 2.0 mm in a thrust direction of the impeller drive shaft 103, and in a range from 0.5 mm to 4.0 mm in a radial direction thereof, 90% of a desired ink pressure can be attained. However, the gear pump is required to have a gap in a range from 0.1 mm to 0.25 mm in the thrust and radial directions; if the gap is wider than 0.25 mm, the ink pressure will decrease by half.

High precision is necessary both in producing and assembling the components in order to obtain a minimum gap and ensure a tightly mounted drive shaft. This adds greatly to the cost of the pump.

Also, in an instance of the recording apparatus for recording with a plurality of colors as in this embodiment, the dispersion in ink pressure for each color ink appears directly as the difference between discharge recovery powers of the recording head, resulting in a lower quality color image being produced.

5. Comparison of Vibration and Noise

Even if a pair of gears are only rotated, mating noise (contact noise between gear faces) will occur, and the discharge pressure may change every time the tooth mates. This causes a vibration or noise of the pump device or the whole apparatus.

In the turbine pump, such vibration or noise will not occur because there is no mating between gears.

6. Comparison of Constitution

The ink pump 100 using the turbine pump according to the present invention is of the simplest constitution compared with other types of pumps, because the impeller 106 is only necessary to be rotated within the casing 101.

Figure 7:
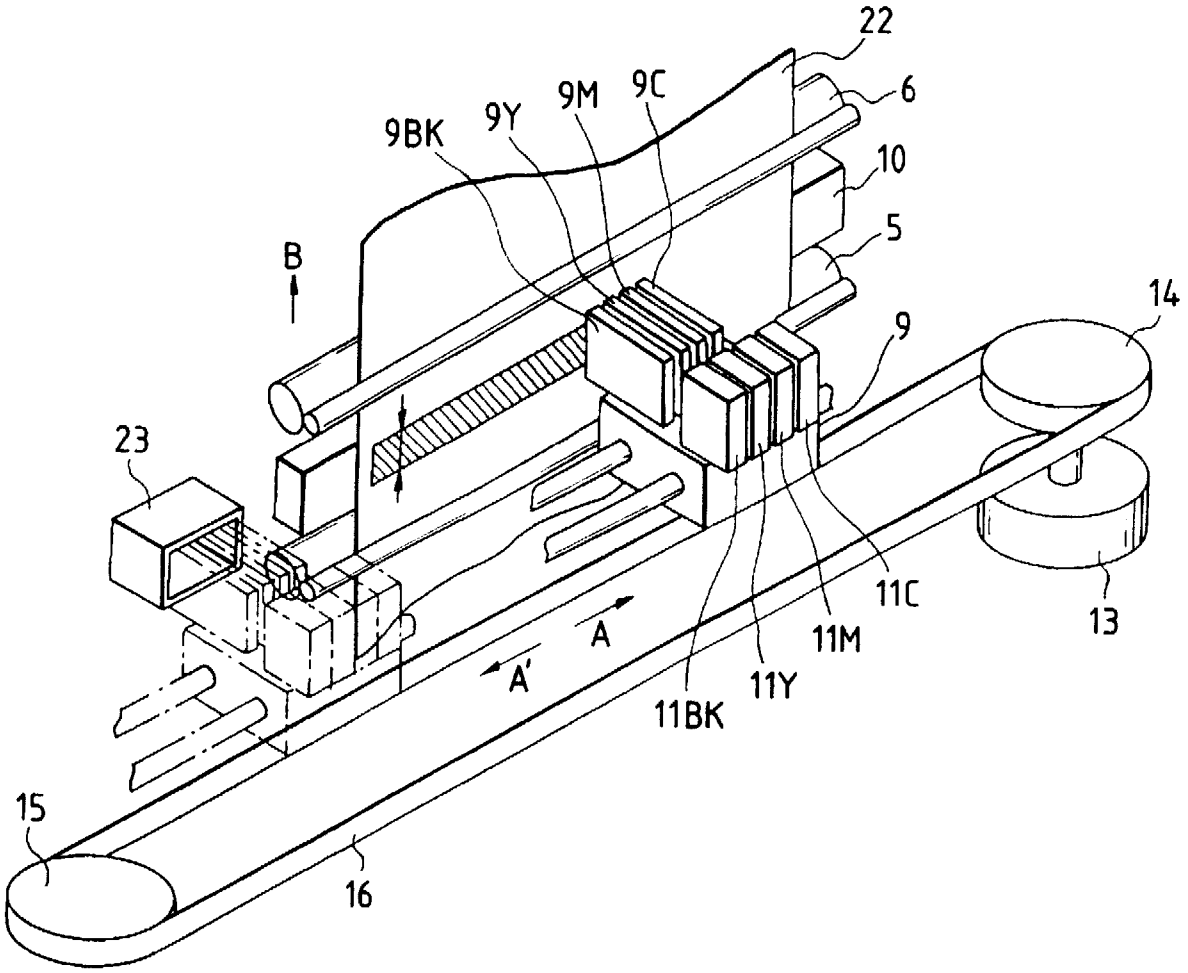
FIG. 7 is a schematic view of an apparatus for explaining an embodiment.

FIG. 7 shows an embodiment of an ink jet recording apparatus of the serial type to which the present invention is applicable. The carriage 9 comprises recording heads $9_C$ to $9_{Bk}$ corresponding to cyan, magenta, yellow and black, and ink cartridges $11_C$ to $11_{Bk}$ corresponding to respective heads. The supply of ink is conducted from the ink cartridge 11 via the ink tank (not shown), as will be described later.

In FIG. 7, a motor 13 for driving the carriage 9 for scanning in the main scan direction (arrows A, A' in the figure), in which the carriage 9 is driven via a drive pulley secured to the motor, a pulley 15 and a belt 16.

The recording medium 22 may be such as roll or cut paper, which is conveyed in a direction of the arrow B in the figure by a sub-scan roller 5 and a tension roller 6. A recovery means 23 is placed to enable processing to prevent deterioration of the image quality of the recording head (hereinafter referred to as pressure recovery). A platen 10 holds the recording medium in plane during the printing.

Figure 8B:
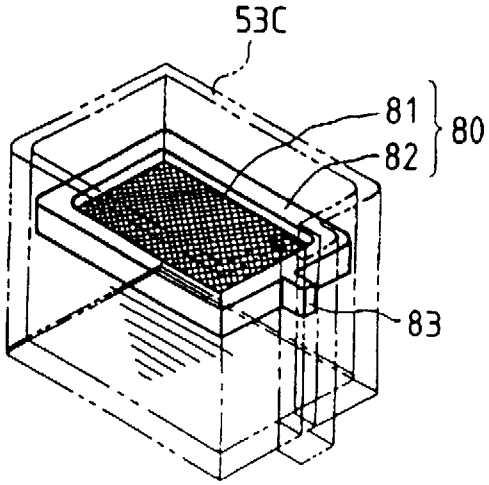
FIGS. 8A and 8B are explanation views of an ink recycle system.
Figure 8A:
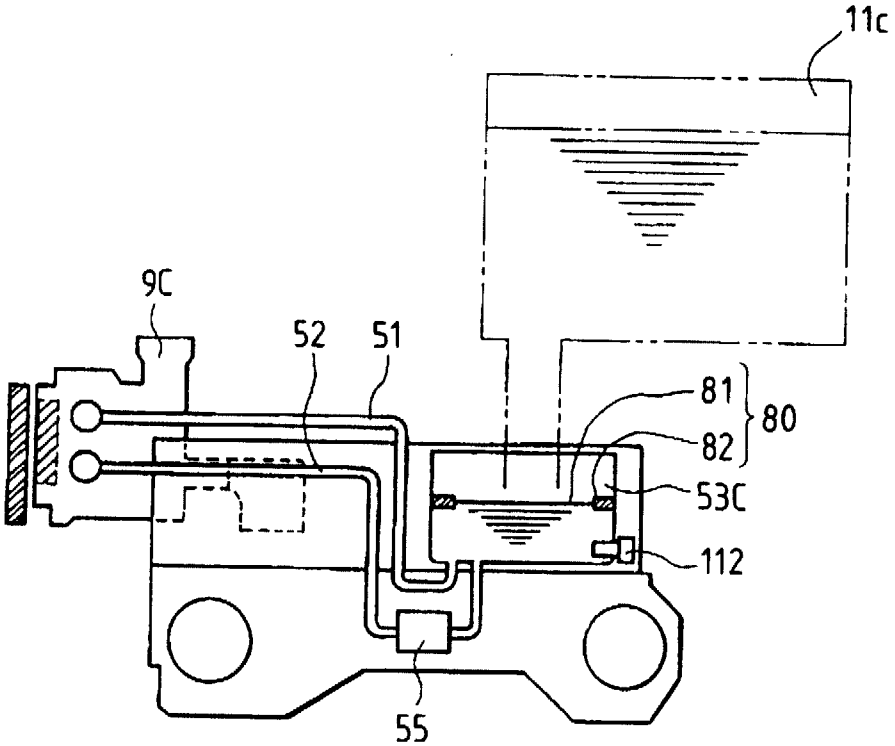

FIGS. 8A and 8B show the essence of another embodiment of an ink jet recording apparatus to which the present invention is applied, in a cross-sectional view (FIG. 8A) and in an essential perspective view (FIG. 8B). The figures show only a portion corresponding to the cyan tank, but the same description applies to the other three colors.

FIG. 8A shows an ink tank 53*c* into which the ink is supplied from the ink cartridge 11*c*. A tube 52 supplies the ink from the ink tank 53*c* to the recording head 9*c*, comprising a pump 55 for pressure recovery midway thereof. A tube 51 connects the ink tank 53*c* to the recording head 9*c*. A float filter 80, floating on the liquid surface of the ink tank 53*c*, consists of a filter main body 81 and a float portion 82. The filter main body 81 uses a thin plate of the SUS type having a diameter of about several μm to tens of μm, and the float portion 82 is of molded resin and is hollow. FIG. 8B shows a projection 83 molded integrally with the float portion 82, which is detected by a sensor 112 when the liquid surface falls down. As shown in the figure, the float filter 80 is configured to cover substantially an entire surface of the ink liquid within the ink tank 53*c*.

The supply of the ink is performed in the following procedure.

A certain amount of ink supplied from the ink cartridge 11*c* into the ink tank 53*c* under the control of a valve not shown first passes through the filter main body 81 of the float filter 80. There is a step between the float main body 81 and the float portion 82 provided around the peripheral edge thereof; a certain mount of ink can reside therein, so that all the ink can flow down through the filter main body 81.

The ink within nozzles inside the recording head 9*c* gradually becomes thicker in viscosity despite the provision of drying preventing means in the non-operation state. This is referred to as thickening, and the operation for removing this thickened ink is referred to as a pressure recovery operation. In this procedure, the carriage 9 is first stopped at a position at which the recording heads $9_C$ to $9_{Bk}$ are opposite recovery means 23. As shown in FIG. 8, by activating the pump 55, the ink filtered by the filter 80 is forced to pass from the ink tank 53*c* via the tube 52 to the recording head 9*c*, thereby expelling the thickened ink out of the nozzles by the increased ink pressure.

Also, during the actual recording, the ink filtered by the filter 80 is supplied from the ink tank 53*c* via the tube 51 to the head 9*c* due to capillary action.

If the quantity of ink within the ink tank 53*c* decreases until the liquid surface reaches a fixed level, the projection 83 of the float portion 82 is detected by the sensor 112 to refill the ink from another ink refill portion (cartridge 11*c* in this embodiment).

Figure 9:
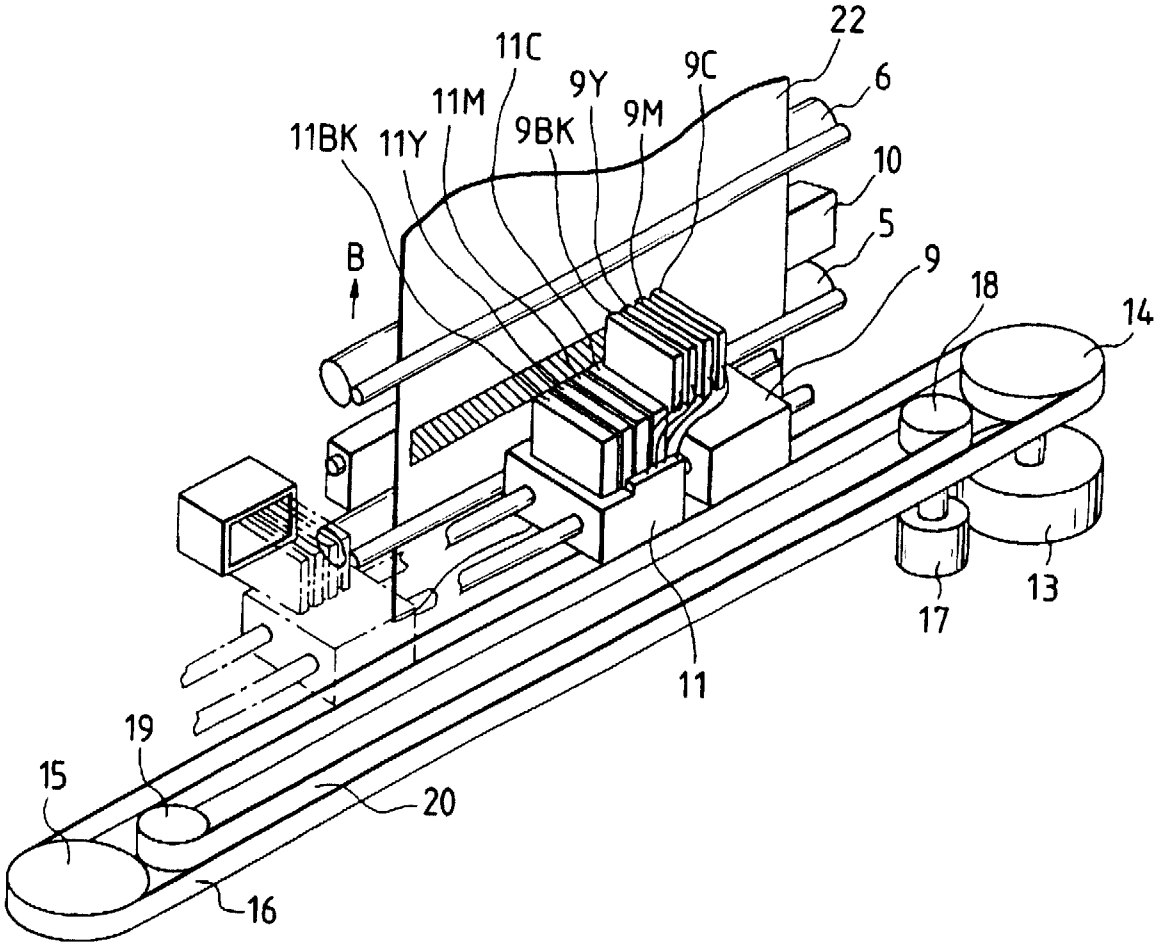
FIG. 9 is a schematic view of an apparatus for explaining an embodiment.

FIG. 9 shows another embodiment. This apparatus is different from that of FIG. 7 only in the ink supply method, but has the same recording method whose explanation is omitted.

A supply system 11 having the ink cartridges $11_C$ to $11_{Bk}$ is moved in cooperation with the movement of the carriage 9, by a driving system apart from that of the carriage 9, that is, consisting of a motor 17, a drive pulley 18, a pulley 19 and a belt 20, as moving body provided separately from the carriage 9.

Figure 10:
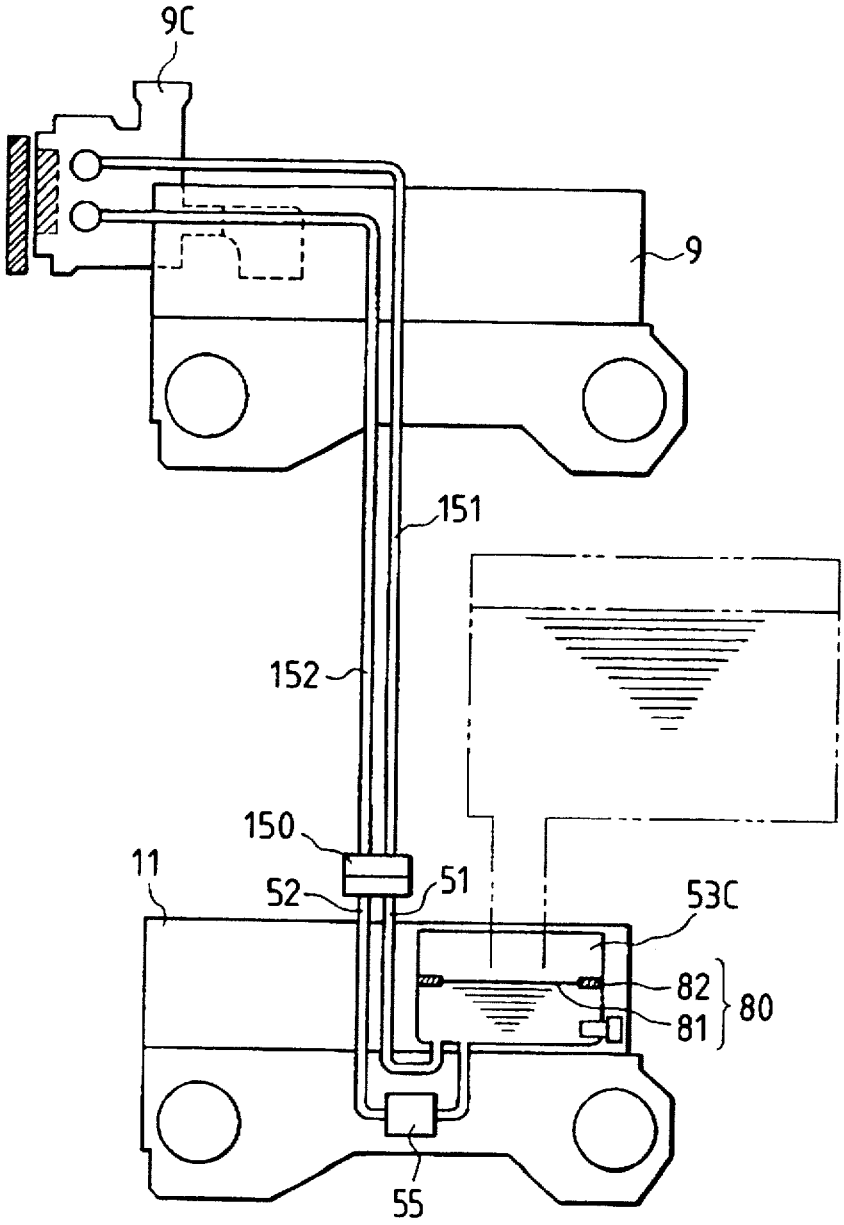
FIG. 10 is a schematic view of an apparatus for explaining an embodiment.

FIG. 10 shows an ink supply passage in the apparatus of FIG. 9. In the pressure recovery operation, the ink within the ink tank 53*c* is forced to pass via the tube 52 by the pump 55, and through a connector portion 150 to a tube 152 on the head 9*c*. In the recording operation, the ink is delivered through the tube 51, the connector portion 150 and a tube 151. On the liquid surface of the ink tank 53*c* is provided a float filter 80 comprised of the filter portion 81 and the float 82. Other operations are the same as in FIG. 8.

Figure 11:
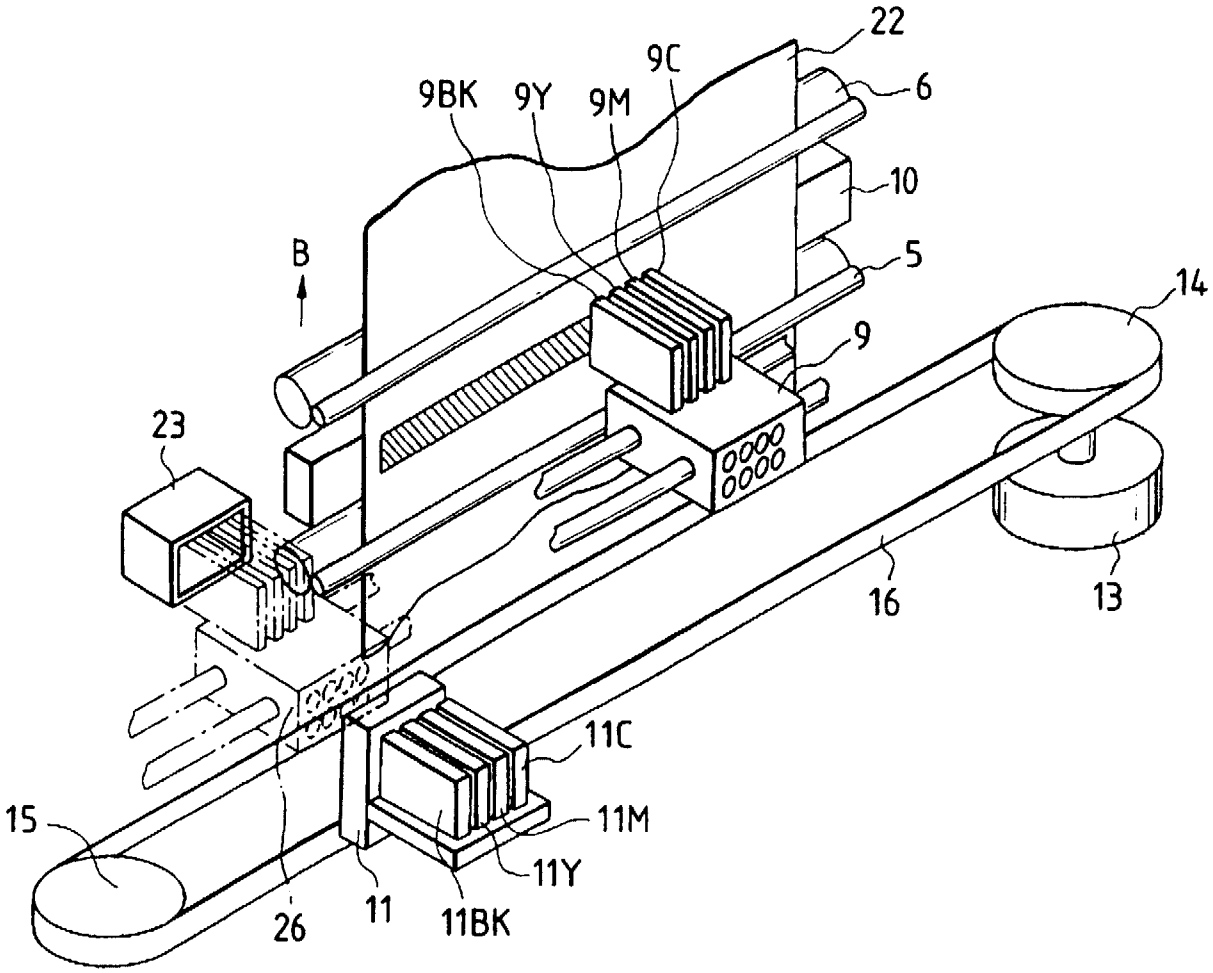
FIG. 11 is a schematic view of an apparatus for explaining an embodiment.

FIG. 11 shows another embodiment. An apparatus of FIG. 11 performs the same basic recording operation as that of FIG. 7.

An ink supply system 11 is provided apart from the carriage 9 and secured to the main device, wherein the supply of the ink is conducted from the ink cartridges $11_C$ to $11_{Bk}$ via a main tank 45*c* to the ink tank within the carriage 9, when the carriage 9 is positioned at 26 indicated by the dashed line in the figure (hereinafter referred to as a supply position).

Figure 12:
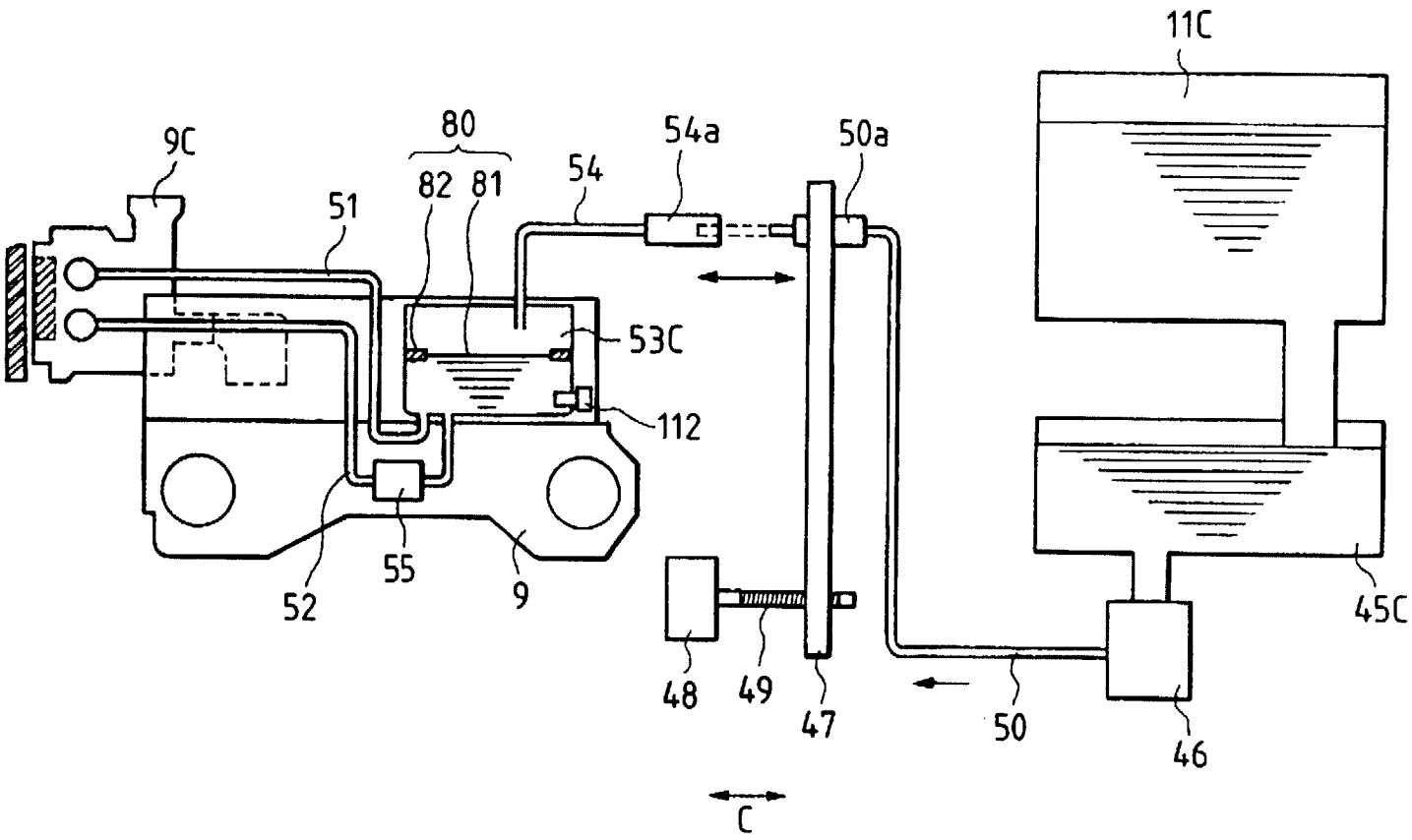
FIG. 12 is a schematic view of an apparatus for explaining an embodiment.
Figure 13:
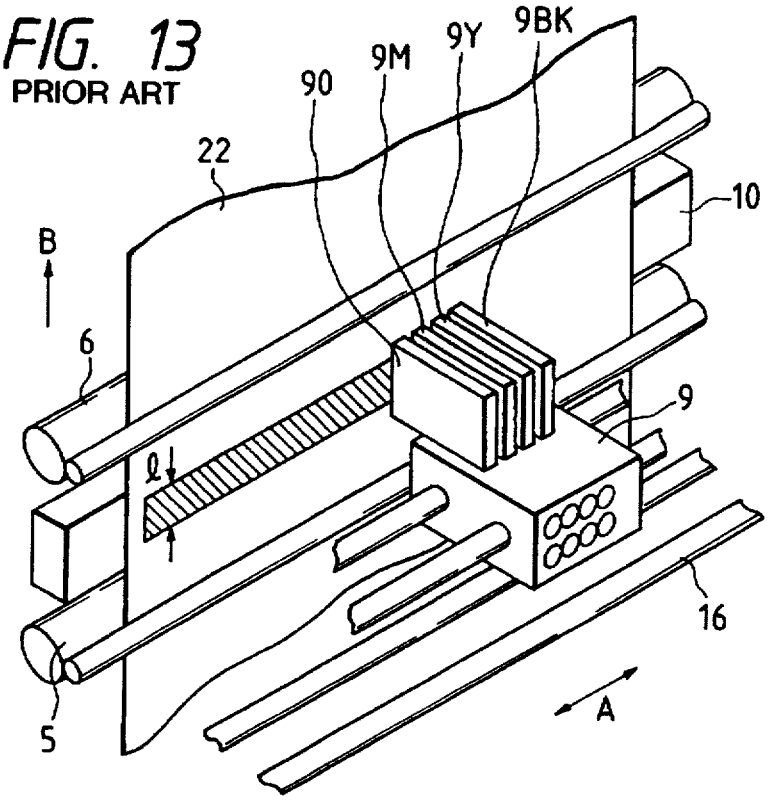
FIG. 13 PRIOR ART
FIG. 13 is a schematic view of an apparatus for explaining a conventional example.
Figure 14:
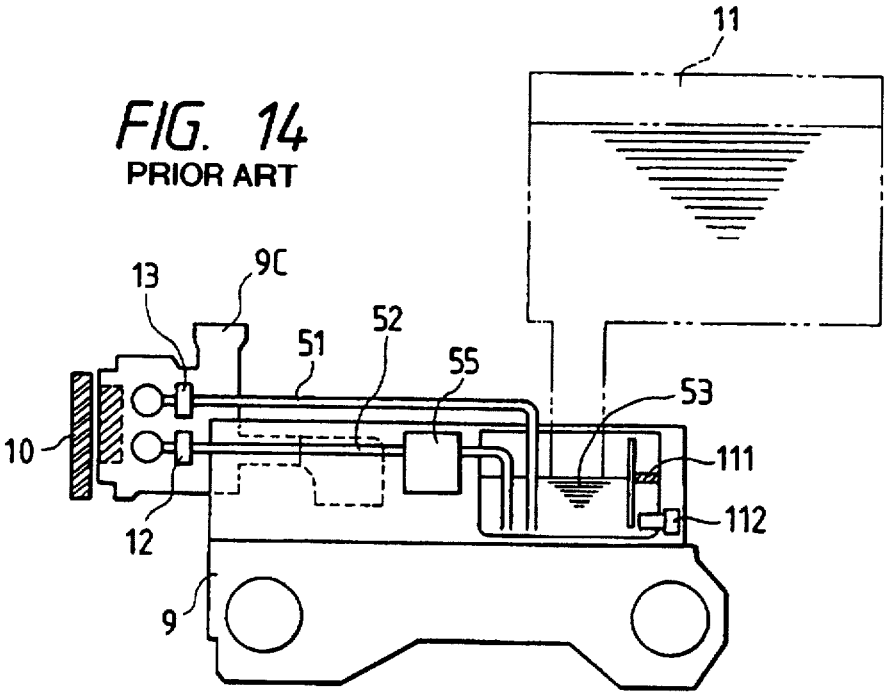
FIG. 14 PRIOR ART
FIG. 14 is an explanation view of an ink recycle system.

Referring now to FIG. 12, the procedure of supplying the ink will be described below. An ink cartridge 11*c* is provided from which the ink is supplied to the main tank 45*c*. A pump 46 supplies the ink to the ink tank 53*c* provided within the carriage 9, and a tube 50 connects a connector portion 50*a* from the pump. A supporting member 47 is provided for supporting the connector portion 50*a* for the ink supply, which is driven in a direction of the arrow C by a motor 48 and a feed screw 49. A tube 54 has a connector portion 54*a* at one end thereof, and supplies the ink to the ink tank 53*c*. A tube 52 supplies the ink from the ink tank 53*c* to the recording head 9*c*, comprising a pump midway thereof. A tube 51 connects the ink tank 53*c* to the recording head 9*c*. A float filter 80 floats on the ink surface in the ink tank 53*c*; float filter 80 is comprised of the filter portion 81 and the float portion 82.

The supply of the ink is performed in the following procedure. Upon the carriage 9 reaching a predetermined ink supply position, the motor 48 is activated to make a connection between the connect portions 50*a* and 54*a*. In this state, if the pump 46 is activated, the ink in the main tank 45 is forced to flow through the tube 50, the connector portions 50*a*, 54*a* and the tube 54 into the filter portion 81 of the float filter 80. The ink which has entered the filter portion 81 flows into the ink tank 53c after being filtered through the meshes of the filter.

The flow of ink from the float filter portion via the ink tank 53c to the head 9c as well as the direction with respect to that sensor 112 are the same as shown in FIG. 8.

The present invention brings about excellent effects particularly in a recording head or a recording device of the ink jet system in which the recording is performed by forming fine ink droplets by the use of the thermal energy among the various ink jet recording systems.

As to its representative constitution and principle, for example, one practiced by use of the basic principle disclosed in, for example, U.S. Pat. Nos. 4,723,129 and 4,740,796 is preferred . This system is applicable to either of the so-called on-demand type and the continuous type. Particularly, the case of the on-demand type is effective because, by applying at least one driving signal which gives rapid temperature elevation exceeding nucleus boiling corresponding to the recording information on electrothermal converters arranged corresponding to the sheets or liquid channel holding a liquid (ink), thermal energy is generated at the electrothermal converters to effect film boiling at the heat acting surface of the recording head, and consequently the bubbles within the liquid (ink) can be formed corresponding one by one to the driving signals. By discharging the liquid (ink) through an opening for discharging by growth and shrinkage of the bubble, at least one droplet is formed. By making the driving signals into the pulse shapes, growth and shrinkage of the bubbles can be effected instantly and adequately to accomplish more preferably discharging of the liquid (ink) particularly excellent in response characteristic.

With regard to the driving signals of such pulse shape, those as disclosed in U.S. Pat. Nos. 4,463,359 and 4,345,262 are suitable. Further excellent recording can be performed by employment of the conditions described in U.S. Pat. No. 4,313,124 of the invention concerning the temperature elevation rate of the above-mentioned heat acting surface.

With regard to the constitution of the recording head, in addition to the combination of the discharging port, liquid channel, and electrothermal converter (linear liquid channel or right-angled liquid channel) as disclosed in the above-mentioned respective specifications, the constitution of U.S. Pat. Nos. 4,558,333 or 4,459,600 disclosing the constitution having the heat acting portion arranged in the flexed region is also included in the present invention.

In addition, the present invention can be also effectively made the constitution as disclosed in Japanese Laid-Open Patent Application No. 59-123670 which discloses the constitution using a slit common to a plurality of electrothermal converters as the discharging portion of the electrothermal converter, or Japanese Laid-Open Patent Application No. 59-138461 which discloses the constitution having the opening for absorbing a pressure wave of thermal energy corresponding to the discharging portion.

Further, in a recording head of the full line type having a length corresponding to the maximum width of a recording sheet (recording medium) which can be recorded by the recording device, either the constitution wherein its length is composed of a combination of a plurality of recording heads as disclosed in the above-mentioned specifications or the constitution as one recording head integrally formed may be used, and the present invention can exhibit the effects described above still more effectively.

In addition, the present invention is effective for a recording head of the freely exchangeable chip type which enables electrical connection to the main device or supply of ink from the main device by being mounted on the main device, or a recording head of the cartridge type having an ink tank integrally provided on the recording head itself.

Also, addition of a restoration means for the recording head, a preliminary auxiliary means, etc., provided as the constitution of the recording device of the present invention is preferable, because the effect of the present invention can be further stabilized. Specific examples of these may include, for the recording head, capping means, cleaning means, pressurization or suction means, electrothermal converters or another type of heating elements, or preliminary heating means according to a combination of these, and it is also effective for performing stable recording by operating in a preliminary mode which performs discharging separate from recording.

Further, with regard to the recording mode of the recording device, the present invention is extremely effective for not only the recording mode of a primary color such as black etc., but also a device equipped with at least one of plural different colors or full color by color mixing, whether the recording head may be either integrally constituted or combined in plural number.

In addition, though the ink is considered as a liquid in the embodiments as above described, another ink may be also usable which is solid below room temperature and will soften or liquefy at or above room temperature, or liquefy when a recording enable signal is issued as is common in ink jet devices, which control the viscosity of ink to be maintained within a certain range of the stable discharge by adjusting the temperature of the ink in a range from 30° C. to 70° C.

In addition, in order to avoid the temperature elevation due to thermal energy by positively utilizing the thermal energy as the energy for the change of state from solid to liquid, or to prevent the evaporation of ink by using ink which will stiffen in the shelf state, the use of the ink having a property of liquefying only with the application of thermal energy, such as liquefying with the application of thermal energy in accordance with a recording signal so that liquid link is discharged, or may solidify prior to reaching a recording medium, is also applicable in the present invention. In such a case, the ink may be held as liquid or solid in recesses or through holes of a porous sheet, which is placed opposed to electrothermal converters, as described in Japanese Laid-Open Patent Application No. 54-56847 or No. 60-71260. The most effective method for the ink as above described in the present invention is based on the film boiling.

Further, a recording apparatus according to the present invention may be used in the form of an image output terminal in the information processing equipment such as a word processor or computer, provided integrally or separately, a copying machine in combination with a reader, or a facsimile terminal equipment having the transmission and reception feature.

As described above, since the ink supply device in this embodiment can supply the ink to the recording head by pressurizing the ink without any sliding portion or contact portion in the ink, it is possible to form high quality images over a long time, resulting in a longer life for the recording head, while preventing the occurrence of discharge failures or the decrease in discharge recovery ability due to clogging with contaminants.

Owing to the provision of a float filter on the ink liquid surface of the ink refill means cooperating with a moving carriage, which can cover substantially an entire surface thereof, the following effects are obtained:

Contaminants from outside can be prevented from entering.

The filter can be readily exchanged because it is floating on the liquid surface, but not fixed.

Fluctuations on the ink liquid surface due to inertia can be suppressed as the filter member covers substantially the entire surface of the liquid surface in the ink tank reciprocating at high speed, so that the stable ink discharge operation can be maintained, and a compact ink tank can be made.

No float portion for detecting remaining ink needs be provided separately.

What is claimed is:

1. An ink supply device for supplying ink to an ink jet recording head for discharging ink through an ink discharge port onto a recording medium to record, said device comprising:

a shaft member rotated and driven by a drive means;

an impeller provided on an end of said shaft member and rotating in accordance with the rotation of said shaft member;

a first ink storing portion for storing ink to be supplied to said ink jet recording head;

a second ink storing portion for storing ink to be supplied to said first ink storing portion, said second ink storing portion having an ink supply member guided into said first ink storing portion, an ink level of said first ink storing portion being maintained at a leading end of said ink supply member; and a housing having an inflow portion communicating with said first ink storing portion and said second ink storing portion to flow ink thereinto and an outflow portion provided tangentially with respect to a rotation direction of said impeller to supply ink to said ink jet recording head, said housing having said impeller therein and being located below said leading end of said ink supply member, said ink jet recording head and said first ink storing portion communicating with each other by a first route through said housing and by a second route different from said first route, wherein during a recovery operation of said recording head the ink is supplied from said first ink storing portion to said ink jet recording head by said first route and back to said first ink storing portion by said second route, during a recording operation of said recording head the ink is supplied from said first ink storing portion to said ink jet recording head by said first route and by said second route due to a capillary force, and said impeller rotates during the recovery operation of said recording head and is stopped during the recording operation of said recording head.

2. An ink supply device according to claim 1, characterized in that a partition member with said first ink storing portion is provided directly below a support member rotatably supporting said shaft member above said first ink storing portion.

3. An ink supply device according to claim 1, characterized in that said recording head comprises electrothermal converters for generating the thermal energy for use with the discharge of the ink to discharge the ink through the discharge port.

4. An ink jet recording apparatus for recording on a recording medium by using an ink jet recording head for discharging ink through an ink discharge port, said apparatus comprising:

an ink supply device for supplying the ink to said ink jet recording head for discharging the ink through the ink discharge port onto the recording medium to record, said device comprising a head holding portion for holding said ink jet recording head;

a drive means;

a shaft member rotated and driven by said drive means;

an impeller provided on an end of said shaft member and rotating in accordance with the rotation of said shaft member;

a first ink storing portion for storing ink to be supplied to said ink jet recording head;

a second ink storing portion for storing ink to be supplied to said first ink storing portion, said second ink storing portion having an ink supply member guided into said first ink storing portion, an ink level of said first ink storing portion being maintained at a leading end of said ink supply member; and a housing having an inflow portion communicating with said first ink storing portion and said second ink storing portion to flow ink thereinto and an outflow portion provided tangentially with respect to a rotation direction of said impeller to supply ink to said ink jet recording head, said housing having said impeller therein and being located below said leading end of said ink supply member, said ink jet recording head and said first ink storing portion communicating with each other by a first route through said housing and by a second route different from said first route, wherein during a recovery operation of said recording head the ink is supplied from said first ink storing portion to said ink let recording head by said first route and back to said first ink storing portion by said second route, during a recording operation of said recording head the ink is supplied from said first ink storing portion to said ink let recording head by said first route and by said second route due to a capillary force, and said impeller rotates during the recovery operation of said recording head and is stopped during the recording operation of said recording head.

5. An ink jet recording apparatus according to claim 4, characterized in that said ink supply device further comprises a partition member with said first ink storing portion directly below a support member rotatably supporting said shaft member above said first ink storing portion.

6. An ink jet recording apparatus according to claim 4, characterized in that said recording head comprises electrothermal converters for generating the thermal energy for use with the discharge of the ink to discharge the ink through the discharge port.

7. An ink supply device for supplying ink to an ink jet recording head for discharging ink through an ink discharge port onto a recording medium to record, said device comprising:

a shaft member rotated and driven by a drive means;

an impeller provided on an end of said shaft member and rotating in accordance with the rotation of said shaft member;

an ink storing portion for storing ink to be supplied to said ink jet recording head; and a housing having an inflow portion communicating with said ink storing portion to flow ink thereinto and an outflow portion provided tangentially with respect to a rotation direction of said impeller to supply ink to said ink jet recording head, said housing having said impeller therein, said ink jet recording head and said ink storing portion communicating with each other by a first route through said housing and by a second route different from said first route, wherein during a recovery operation of said recording head the ink is supplied from said ink storing portion to said ink jet recording head by said first route and back to said ink storing portion by said second route, during a recording operation of said recording head the ink is supplied from said ink storing portion to said ink jet recording head by said first route and by said second route due to a capillary force, and said impeller rotates during the recovery operation of said recording head and is stopped during the recording operation of said recording head.

8. An ink supply device according to claim 7, characterized in that a partition member with said ink storing portion is provided directly below a support member rotatably supporting said shaft member above said ink storing portion.

9. An ink supply device according to claim 7, characterized in that said recording head comprises electrothermal converters for generating the thermal energy for use with the discharge of the ink to discharge the ink through the discharge port.

10. An ink jet recording apparatus for recording on a recording medium by using an ink jet recording head for discharging ink through an ink discharge port, said apparatus comprising:

an ink supply device for supplying the ink to said ink jet recording head for discharging the ink through the ink discharge port onto the recording medium to record, said device comprising a head holding portion for holding said ink jet recording head;

a drive means;

a shaft member rotated and driven by said drive means;

an impeller provided on an end of said shaft member and rotating in accordance with the rotation of said shaft member;

an ink storing portion for storing ink to be supplied to said ink jet recording head; and a housing having an inflow portion communicating with said ink storing portion to flow ink thereinto and an outflow portion provided tangentially with respect to a rotation direction of said impeller to supply ink to said ink jet recording head, said housing having said impeller therein, wherein during a recovery operation of said recording head the ink is supplied from said ink storing portion to said ink jet recording head by said first route and back to said ink storing portion by said second route, during a recording operation of said recording head the ink is supplied from said ink storing portion to said ink jet recording head by said first route and by said second route due to a capillary force, and said impeller rotates during the recovery operation of said recording head and is stopped during the recording operation of said recording head.

11. An ink jet recording apparatus according to claim 10, characterized in that said ink supply device further comprises a partition member with said ink storing portion directly below a support member rotatably supporting said shaft member above said ink storing portion.

12. An ink jet recording apparatus according to claim 10, characterized in that said recording head comprises electrothermal converters for generating the thermal energy for use with the discharge of the ink to discharge the ink through the discharge port.

13. An apparatus according to claim 1 or claim 4, wherein said impeller has a blade member having a curved surface parallel to an axial direction of said shaft member.

14. An apparatus according to claim 1 or claim 4, wherein said impeller supplies ink under pressure to perform recovery under pressure of said ink jet head when recording is performed.

15. An apparatus according to claim 7 or claim 10, wherein said impeller has a blade member having a curved surface parallel to an axial direction of said shaft member.

16. An apparatus according to claim 7 or claim 10, wherein said impeller supplies ink under pressure to perform recovery under pressure of said ink jet head when recording is performed.

* * * * *

UNITED STATES PATENT AND TRADEMARK OFFICE

CERTIFICATE OF CORRECTION

PATENT NO. : 5,793,395

DATED : August 11, 1998

INVENTORS : KIYOHARU TANAKA, et al.

It is certified that error appears in the above-identified patent and that said Letters Patent is hereby corrected as shown below:

COLUMN 8

Line 37, change "g ear" to --gear--.

COLUMN 12

Line 40, change "link" to --ink--.

COLUMN 14

Line 35, change "let" to --jet--.

Line 40, change "let" to --jet--.

Signed and Sealed this

Fourth Day of May, 1999

*Attest:*

*Attesting Officer*

Q. TODD DICKINSON

*Acting Commissioner of Patents and Trademarks*